US008405316B2

(12) United States Patent
Giussani et al.

(10) Patent No.: US 8,405,316 B2
(45) Date of Patent: Mar. 26, 2013

(54) CONTROL DEVICE FOR A DISCHARGE LAMP

(75) Inventors: Luca Giussani, San Vittore Olona (IT); Romino Cretone, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 272 days.

(21) Appl. No.: 12/981,378

(22) Filed: Dec. 29, 2010

(65) Prior Publication Data

US 2012/0169255 A1 Jul. 5, 2012

(51) Int. Cl.
*H05B 37/02* (2006.01)

(52) U.S. Cl. ..... 315/224; 315/307; 315/308

(58) Field of Classification Search ..... 315/224, 315/219, 291, 307, 308, DIG. 2, DIG. 5, 315/DIG. 7, 223, 225, 209 R
See application file for complete search history.

(56) References Cited

U.S. PATENT DOCUMENTS

| | | | | |
|---|---|---|---|---|
| 6,822,401 | B2 * | 11/2004 | Borella et al. | 315/291 |
| 7,049,767 | B2 * | 5/2006 | Wilhelm | 315/291 |
| 7,944,156 | B2 * | 5/2011 | Quazi | 315/307 |
| 2008/0290809 | A1 | 11/2008 | Giussani et al. | 315/219 |

* cited by examiner

*Primary Examiner* — David H Vu
(74) *Attorney, Agent, or Firm* — Seed IP Law Group PLLC

(57) ABSTRACT

A control device of a driving circuit of a discharge lamp is described. The driving circuit comprises an half bridge with a high side and a low side switches and the control device comprises a first device configured to control the switching frequency of the half bridge and a second device configured to detect the saturation current condition of the choke or the over current condition by detecting, cycle by cycle, a signal representative of the current passing through the low side switch. The second device generate a signal to cause the turning off of the low side switch and the turning on of the high side switch when the saturation current or over current condition of the choke is detected.

30 Claims, 7 Drawing Sheets

CONTROL DEVICE FOR A DISCHARGE LAMP

BACKGROUND

1. Technical Field

The present disclosure pertains to control devices of discharge lamps and to related systems and methods.

2. Description of the Related Art

Fluorescent lamps typically comprise a glass tube which contains a small quantity of mercury, a low pressure inert gas and phosphorous powders which coat the inside part of the tube. At the extremities two electrodes are present which, connected to a suitable driving circuit, form an arc that permits the discharge of the gas to be generated and maintained.

Among the possible driving circuits the so-called high frequency ballast circuits can be enumerated: these are circuits at output of which an alternating voltage signal is generated at a frequency and amplitude necessary to keep the lamp on; this waveform is produced by a circuit that comprises a couple of transistors driven by an oscillator and which switch at a frequency of tens of KHz, a current limiting coil or choke and a filtering capacitance.

The prior art generally controls the maximum current/voltage of lamp, formed with a closed loop system with limited bandwidth.

US 2008290809 discloses a driving circuit comprising an half bridge and an oscillator adapted to determine the switching frequency of the half bridge. The control circuit comprises regulating means adapted to regulate the value of the switching frequency when the value of the voltage across the lamp exceeds a prefixed value.

Therefore, in the event of a choke saturation, the system reacts to the over current Ic increasing the frequency of the oscillator by an amount proportional to the single over current on more periods.

BRIEF SUMMARY

An embodiment provides a control device of a driving circuit of a discharge lamp, said driving circuit comprising an half bridge with a high side and a low side switches, said control device comprising a first device configured to control the switching frequency of the half bridge, wherein the control device comprises a second device configured to compare, cycle by cycle, a signal representative of the current passing through the discharge lamp with a signal threshold and to control the turning off of the low side switch and the turning on of the high side switch when said signal representative of the current passing through the discharge lamp is equal to or overcomes said signal threshold. In an embodiment, said first device is configured to generate a triangular signal, comprising a rise ramp and a fall ramp, to control the switching frequency of the half bridge and the second device is configured to control the starting of the fall ramp of the triangular signal when said signal representative of the current passing through the discharge ramp is equal to or overcomes said signal threshold. In an embodiment, said first device comprises a first and a second comparator to compare said triangular signal respectively with a low and a high thresholds, said control device comprise a flip-flop set reset having at the set input the output signal of the first comparator and at the reset signal the output signal of the second comparator or the output signal of the second device, the output signal of said flip-flop is configured to control the half bridge and the starting of the fall ramp and the rise ramp of the triangular signal. In an embodiment, said first device comprises a up and down counter configured to generate a digital triangular signal comprising up and down step ramps and to control the switching frequency of the half bridge, the second device being configured to control the inversion of the counting direction of the up/down counter when said signal representative of the current passing through the discharge lamp is equal to or overcomes said signal threshold. In an embodiment, the current which passes through the discharge lamp is the current passing through a choke inductance connected to the discharge lamp and is the current passing through the low side switch. In an embodiment, the turning on of the high side switch occurs after a delay time from the turning off of the low side switch. In an embodiment, an integrated circuit comprises a control device as described herein.

In an embodiment, a control device of a driving circuit of a discharge lamp, said driving circuit comprising an half bridge with a high side and a low side switches, comprises a first device configured to control the switching frequency of the half bridge, wherein the control device comprises a second device configured to compare, cycle by cycle, a signal representative of the current passing through the discharge lamp with at least a first and a second threshold, wherein the second threshold is higher than the first threshold, said second device being configured to measure the time period between the time instants wherein said another signal crosses the first and a second threshold, said second device being configured to compare the measured time period to a prefixed time period and to control the turning off of the low side switch and the turning on of the high side switch when said measured time period is smaller than the prefixed time period. In an embodiment, the control device comprises a third device configured to compare, cycle by cycle, said another signal representative of the current passing through the low side switch to a third threshold, wherein the third threshold is higher than the second threshold, and to control the turning off of the low side switch and the turning on of the high side switch when said signal representative of the current passing through the discharge lamp is equal to or overcomes said third threshold. In an embodiment, said first device is configured to generate a triangular signal, comprising a rise ramp and a fall ramp and to control the switching frequency of the half bridge, said second device being configured to control the starting of the fall ramp of the triangular signal when said measured time period is smaller than the prefixed time period. In an embodiment, said first device comprises a first and a second comparator to compare said triangular signal respectively with a low and a high thresholds, said control device comprise a flip-flop set reset having at the set input the output signal of the first comparator and at the reset signal the output signal of the second comparator or the output signal of the second device, the output signal of said flip-flop is configured to control the half bridge and the starting of the fall ramp and the rise ramp of the triangular signal. In an embodiment, said first device comprises a up and down counter configured to generate a digital triangular signal comprising up and down step ramps to control the switching frequency of the half bridge and the second device is configured to control the inversion of the counting direction of the up/down counter when said measured time period is smaller than the prefixed time period. In an embodiment, the current which passes through the discharge lamp is the current passing through a choke inductance connected to the discharge lamp and is the current passing through the low side switch. In an embodiment, the turning on of the high side switch occurs after a delay time from the turning off of the low side switch. In an embodiment, an integrated circuit comprises a control device as described herein.

In an embodiment, a method of controlling a driving circuit of a discharge lamp, said driving circuit comprising an half bridge with a high side and a low side switches, comprises the control step of the switching frequency of the half bridge, said control step comprising comparing, cycle by cycle, a signal representative of the current passing through the discharge lamp with at least a first and a second threshold, wherein the second threshold is higher than the first threshold, measuring the time period between the time instants wherein said another signal crosses the first and a second threshold, and successively comparing the measured time period to a prefixed time period and controlling the turning off of the low side switch and the turning on of the high side switch when said measured time period is smaller than the prefixed time period.

In an embodiment, a method of controlling a driving circuit of a discharge lamp, said driving circuit comprising an half bridge with a high side and a low side switches, comprises the control step of the switching frequency of the half bridge, said control step comprising comparing, cycle by cycle, a signal representative of the current passing through the discharge lamp with a signal threshold and controlling the turning off of the low side switch and the turning on of the high side switch when said a signal representative of the current passing through the discharge lamp is equal to or overcomes said signal threshold.

In an embodiment, a device comprises: a switching frequency control module configured to generate one or more signals to control a high-side and a low-side switch of a half bridge of a discharge lamp; and a comparator module coupled to the switching frequency control module and configured to compare a signal representative of a current passing through the discharge lamp with a first threshold and to generate an output of the comparator module based on the comparison, wherein the switching frequency control module is configured to turn off the low-side switch and turn on the high-side switch in response to the output of the comparator module. In an embodiment, the switching frequency control module is configured to turn off the low-side switch and turn on the high-side switch when the output of the comparator module indicates the signal representative of the current passing through the discharge lamp equals or exceeds the first threshold. In an embodiment, said switching frequency control module is configured to generate a triangular signal, comprising a rise ramp and a fall ramp, to control a switching frequency of the half bridge and to control starting of the fall ramp of the triangular signal when the output of the comparator module indicates said signal representative of the current passing through the discharge ramp equals or exceeds the first threshold. In an embodiment, said switching frequency control module comprises: a first comparator configured to compare said triangular signal with a low threshold; a second comparator configured to compare said triangular signal with a high threshold; and a flip-flop having a set input coupled to an output of the first comparator and a reset input coupled to an output of the second comparator and to an output of the comparator module, wherein the switching frequency control module is configured to control the half bridge and the starting of the fall ramp and the rise ramp of the triangular signal based on an output of the flip-flop. In an embodiment, said switching frequency control module comprises an up/down counter configured to generate a digital triangular signal comprising up and down step ramps to control the switching frequency of the half bridge, wherein the switching frequency control module is configured to control inversion of a counting direction of the up/down counter based at least in part on whether the output of the comparator module indicates said signal representative of the current passing through the discharge lamp equals or exceeds said first threshold. In an embodiment, the signal representative of the current which passes through the discharge lamp is a current passing through a choke inductance coupled to the discharge lamp and through the low-side switch. In an embodiment, the switching frequency control module is configured to delay turning on of the high-side switch for a delay time after turning off of the low-side switch. In an embodiment, the comparator module comprises: a first comparator configured to compare the signal representative of the current which passes through the discharge lamp with a second threshold; and a second comparator configured to compare the signal representative of the current which passes through the discharge lamp with a third threshold, higher than the second threshold, wherein the comparator module is configured to measure a time period between when the signal representative of the current which passes through the discharge lamp exceeds the second threshold and when the signal representative of the current which passes through the discharge lamp exceeds the third threshold, to compare the measured time period to a threshold time period and to generate the output of the comparator module based on the comparison of the measured time period to the threshold time period. In an embodiment, the switching frequency control module is configured to turn off the low-side switch and turn on the high-side switch when the output of the comparator module indicates the measured time period is smaller than the threshold time period. In an embodiment, the switching frequency control module and the comparator module are modules of an integrated circuit.

In an embodiment, a device comprises: a switching frequency control module configured to generate one or more signals to control a high-side and a low-side switch of a half bridge of a discharge lamp; and a comparator module coupled to the switching frequency control module and configured to compare a signal representative of a current through the discharge lamp with at least a first threshold and a second threshold higher than the first threshold, to measure a time period between when the signal representative of the current through the discharge lamp passes the first threshold and when the signal representative of the current through the discharge lamp passes the second threshold, to compare the measured time period to a threshold time period, and to generate a signal to cause the switching frequency control module to turn off the low-side switch and turn on the high-side switch when the measured time period is less than the threshold time period. In an embodiment, the comparator module comprises: a first comparator configured to compare the signal representative of the current through the discharge lamp to the first threshold; a second comparator configured to compare the signal representative of the current through the discharge lamp to the second threshold; and a third comparator configured to compare the signal representative of the current through the discharge lamp to a third threshold higher than the second threshold, wherein the comparator module is configured to generate the signal to cause the switching frequency control module to turn off the low-side switch and turn on the high-side switch when the signal representative of the current through the discharge lamp exceeds the third threshold. In an embodiment, said switching frequency control module is configured to generate a triangular signal, comprising a rise ramp and a fall ramp to control a switching frequency of the half bridge, and to control starting of the fall ramp of the triangular signal based on the signal generated by the comparator module. In an embodiment, said switching frequency control module comprises: a first comparator configured to compare said triangular signal with a low threshold; a second comparator configured to compare said triangular signal with a high threshold; and a flip-flop having a set input coupled to an output of the first comparator and a reset input coupled to an output of the second comparator and to the signal generated by the comparator module, wherein the switching frequency control module is configured to control the half bridge and starting of the fall ramp and the rise ramp of the triangular signal based on an output of the flip-flop. In an embodiment, said switching frequency control module comprises an up/down counter configured to generate a digital triangular signal comprising up and down step ramps to control a switching frequency of the half bridge and to control inversion of a counting direction of the up/down counter based on the signal generated by the comparator module. In an embodiment, the signal representative of the current which passes through the discharge lamp is a current passing through a choke inductance connected to the discharge lamp and through the low-side switch. In an embodiment, the switching frequency control module is configured to delay turning on of the high-side switch for a delay time after turning off of the low-side switch. In an embodiment, the switching frequency control module and the comparator module are modules of an integrated circuit.

In an embodiment, a method comprises: controlling a switching frequency of a driving circuit of a discharge lamp, by: generating drive signals for a high-side switch and a low-side switch of a half-bridge of the discharge lamp; comparing a signal representative of a current passing through the discharge lamp with at least a first and a second threshold, wherein the second threshold is higher than the first threshold; measuring a time period between time instants wherein said signal representative of the current passing through the discharge lamp crosses the first and second thresholds; comparing the measured time period to a threshold time period; and turning off of the low-side switch and turning on the high-side switch when said measured time period is smaller than the threshold time period. In an embodiment, the method further comprises: comparing the signal representative of the current through the discharge lamp to a third threshold higher than the second threshold; and turning off the low-side switch and turning on the high-side switch when the signal representative of the current through the discharge lamp exceeds the third threshold. In an embodiment, the signal representative of the current through the discharge lamp is a current through the low-side switch.

In an embodiment, a method comprises: controlling a switching frequency of a driving circuit of a discharge lamp, by: generating drive signals for a high-side switch and a low-side switch of a half-bridge of the discharge lamp; comparing a signal representative of a current passing through the discharge lamp with at least a first threshold; and turning off the low-side switch and turning on the high-side switch when the signal representative of the current through the discharge lamp exceeds the at least a first threshold. In an embodiment, turning off the low-side switch and turning on the high-side switch comprises resetting a flip-flop. In an embodiment, the method further comprises: delaying turning on of the hide-side switch by a delay time after turning off of the low-side switch.

In an embodiment, a system comprises: a discharge lamp having a half bridge with a hide-side switch and a low-side switch; and a controller including: a switching frequency control module configured to generate one or more signals to control the high-side and the low-side switches of the half bridge of the discharge lamp; and a comparator module coupled to the switching frequency control module and configured to compare a signal representative of a current passing through the discharge lamp with a first threshold and to generate an output of the comparator module based on the comparison, wherein the switching frequency control module is configured to turn off the low-side switch and turn on the high-side switch in response to the output of the comparator module. In an embodiment, said switching frequency control module is configured to generate a triangular signal, comprising a rise ramp and a fall ramp, to control a switching frequency of the half bridge and to control starting of the fall ramp of the triangular signal when the output of the comparator module indicates said signal representative of the current passing through the discharge ramp equals or exceeds the first threshold. In an embodiment, said switching frequency control module comprises: a first comparator configured to compare said triangular signal with a low threshold; a second comparator configured to compare said triangular signal with a high threshold; and a flip-flop having a set input coupled to an output of the first comparator and a reset input coupled to an output of the second comparator and to an output of the comparator module, wherein the switching frequency control module is configured to control the half bridge and the starting of the fall ramp and the rise ramp of the triangular signal based on an output of the flip-flop. In an embodiment, said switching frequency control module comprises an up/down counter configured to generate a digital triangular signal comprising up and down step ramps to control the switching frequency of the half bridge, wherein the switching frequency control module is configured to control inversion of a counting direction of the up/down counter based at least in part on whether the output of the comparator module indicates said signal representative of the current passing through the discharge lamp equals or exceeds said first threshold.

In an embodiment, a system comprises: a discharge lamp having a half bridge with a hide-side switch and a low-side switch; a switching frequency control module configured to generate one or more signals to control the high-side and the low-side switches of the half bridge of the discharge lamp; and a comparator module coupled to the switching frequency control module and configured to compare a signal representative of a current through the discharge lamp with at least a first threshold and a second threshold higher than the first threshold, to measure a time period between when the signal representative of the current through the discharge lamp passes the first threshold and when the signal representative of the current through the discharge lamp passes the second threshold, to compare the measured time period to a threshold time period, and to generate a signal to cause the switching frequency control module to turn off the low-side switch and turn on the high-side switch when the measured time period is less than the threshold time period. In an embodiment, the comparator module comprises: a first comparator configured to compare the signal representative of the current through the discharge lamp to the first threshold; a second comparator configured to compare the signal representative of the current through the discharge lamp to the second threshold; and a third comparator configured to compare the signal representative of the current through the discharge lamp to a third threshold higher than the second threshold, wherein the comparator module is configured to generate the signal to cause the switching frequency control module to turn off the low-side switch and turn on the high-side switch when the signal representative of the current through the discharge lamp exceeds the third threshold.

BRIEF DESCRIPTION OF THE SEVERAL VIEWS OF THE DRAWING(S)

Figure 3:
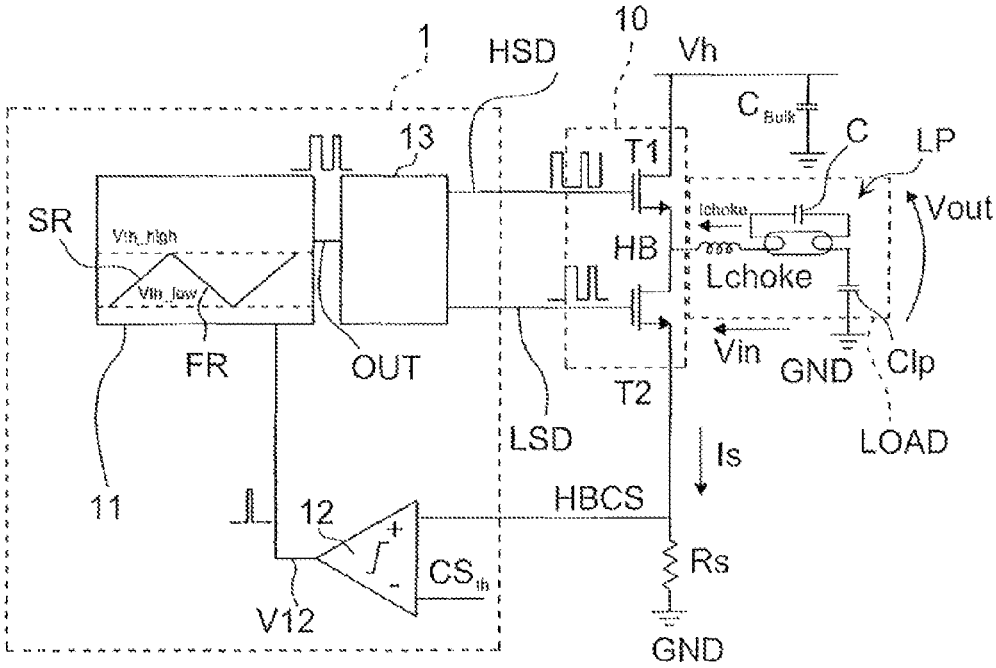
FIG. 3 is a schematic view of a control device for a discharge lamp according to an embodiment.
Figure 5:
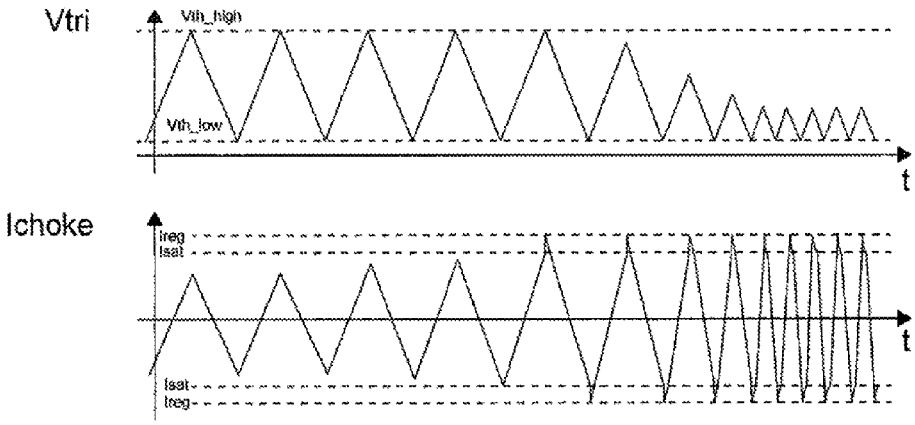
FIG. 5 shows example time diagrams of the output voltage of the oscillator and of the current passing through a choke coil in the circuit in FIG. 3 with Ireg>Isat.
Figure 5A:
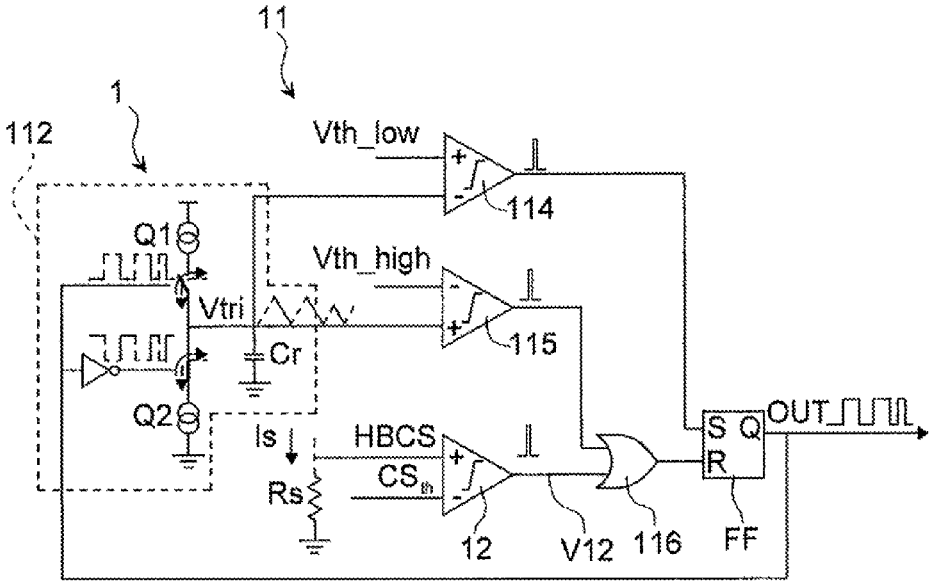
Figure 6:
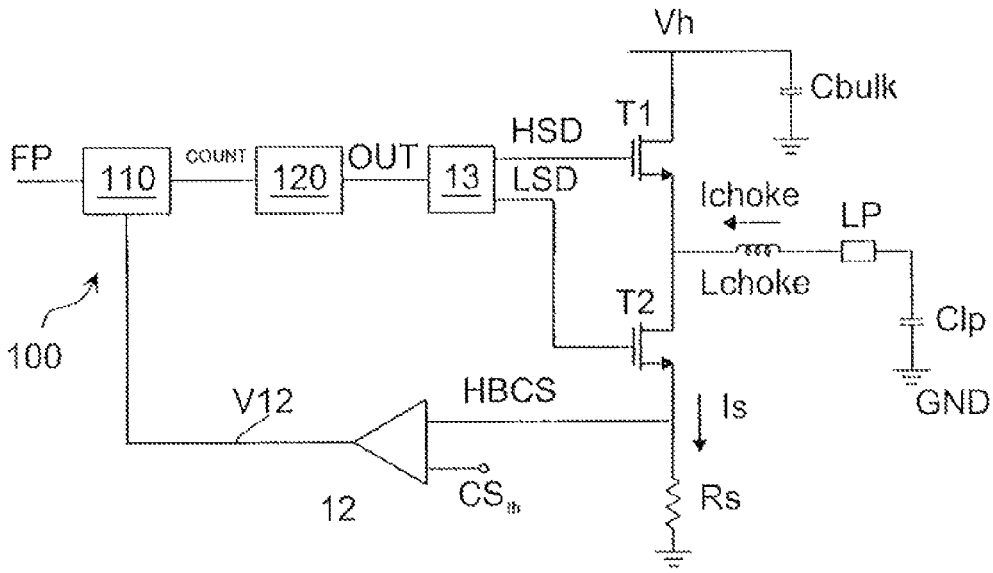
Figure 6A:
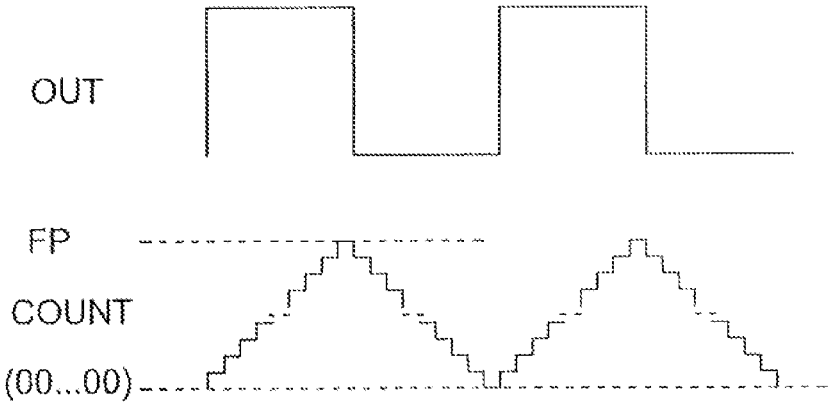
Figure 7:
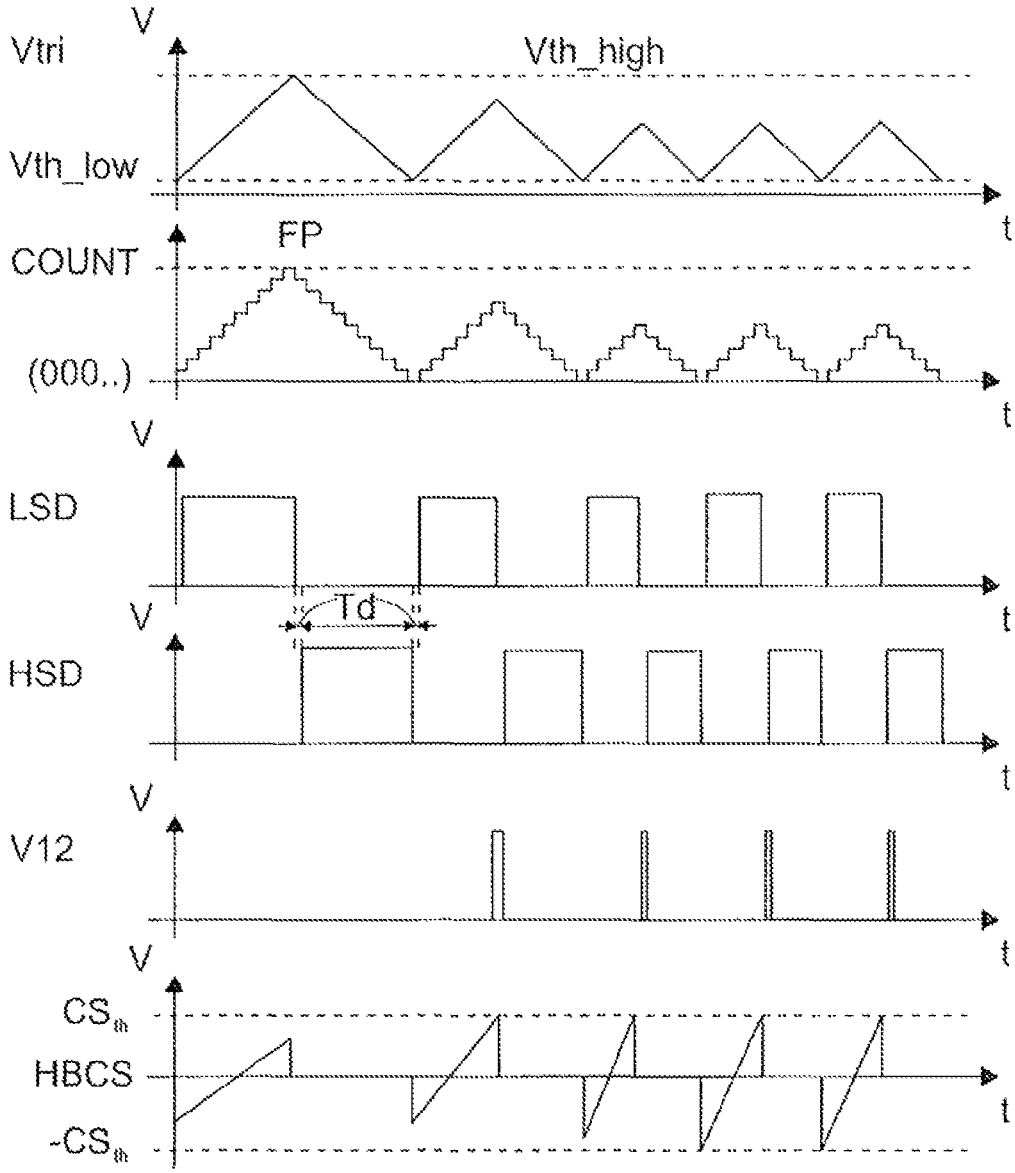
Figure 8:
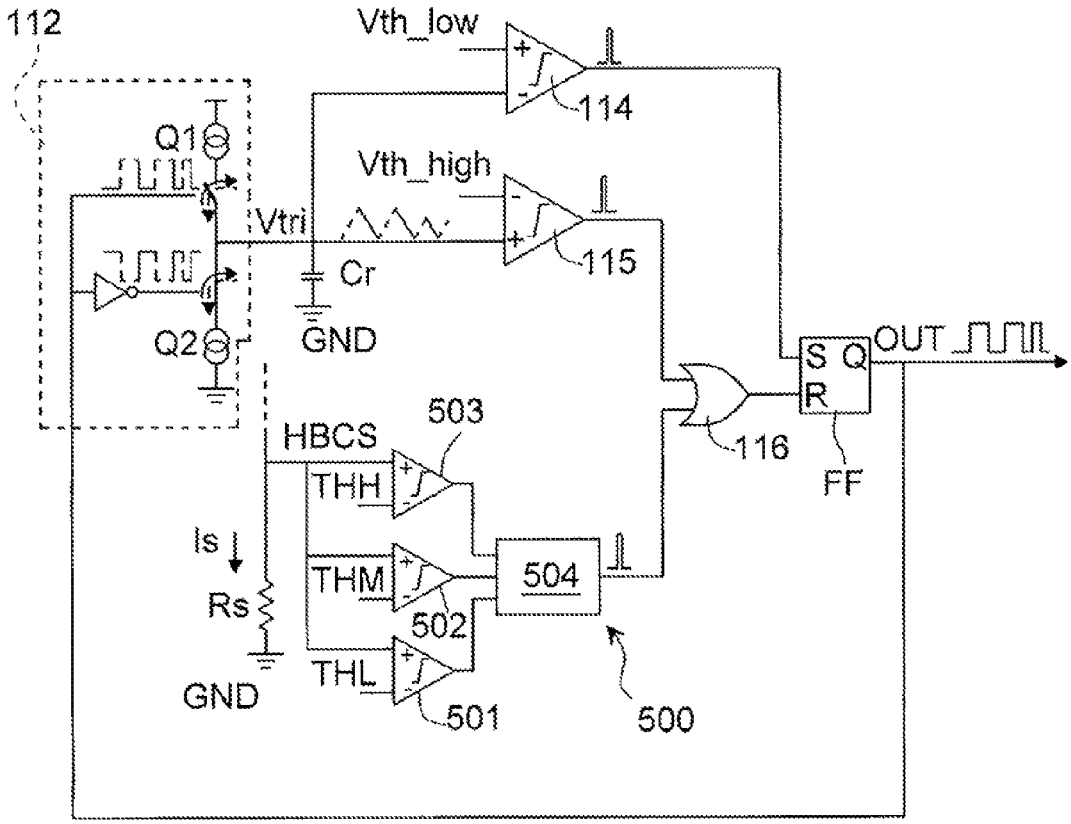
Figure 10:
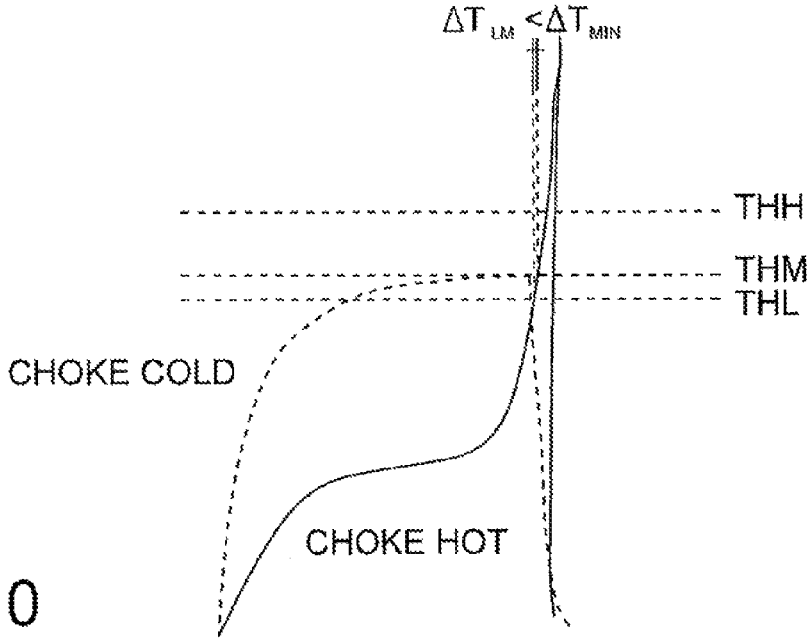
Figure 9:
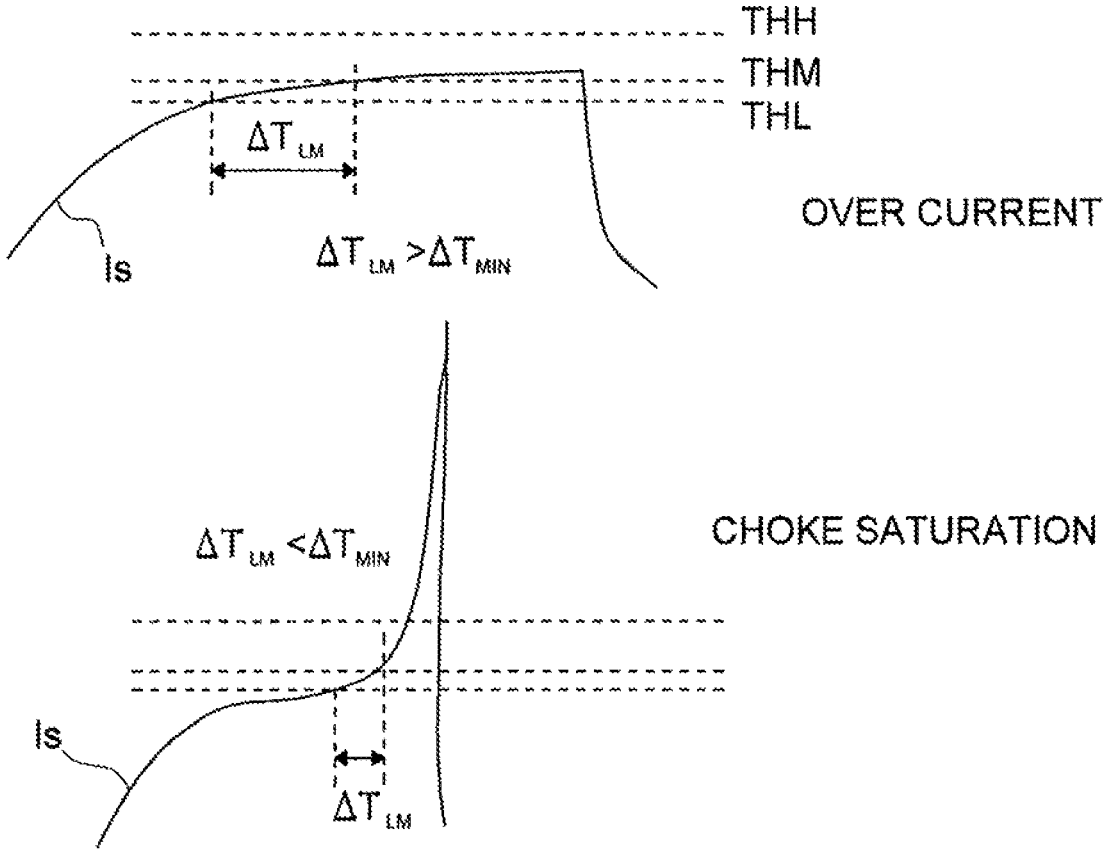

FIG. 5*a* shows a schematic view of an embodiment of an implementation of a part of the embodiment of FIG. 3;

FIG. 6 is a schematic view of a control device for a discharge lamp according to an embodiment;

FIG. 6*a* shows example time diagrams of signals in the embodiment of FIG. 6;

FIG. 7 shows example time diagrams of signals in the embodiments of FIGS. 3 and 6;

FIG. 8 is a schematic view of a control device for a discharge lamp according to an embodiment;

FIG. 9 shows example time diagrams of the current passing through a choke coil in the case of over current and choke saturation for the embodiment in FIG. 8;

FIG. 10 shows an example time diagram of the current passing through a choke coil for the embodiment in FIG. 8 in the case wherein the current is affected by an increasing of temperature.

DETAILED DESCRIPTION

In the following description, certain details are set forth in order to provide a thorough understanding of various embodiments of devices, methods and articles. However, one of skill in the art will understand that other embodiments may be practiced without these details. In other instances, well-known structures and methods associated with, for example, discharge lamps oscillators, driving circuits, etc., have not been shown or described in detail in some figures to avoid unnecessarily obscuring descriptions of the embodiments.

Unless the context requires otherwise, throughout the specification and claims which follow, the word "comprise" and variations thereof, such as "comprising," and "comprises," are to be construed in an open, inclusive sense, that is, as "including, but not limited to."

Reference throughout this specification to "one embodiment," or "an embodiment" means that a particular feature, structure or characteristic described in connection with the embodiment is included in at least one embodiment. Thus, the appearances of the phrases "in one embodiment," or "in an embodiment" in various places throughout this specification are not necessarily referring to the same embodiment, or to all embodiments. Furthermore, the particular features, structures, or characteristics may be combined in any suitable manner in one or more embodiments to obtain further embodiments.

The headings are provided for convenience only, and do not interpret the scope or meaning of this disclosure or the claims.

The sizes and relative positions of elements in the drawings are not necessarily drawn to scale. For example, the shapes of various elements and angles are not drawn to scale, and some of these elements may be enlarged and positioned to improve drawing legibility. Further, the particular shapes of the elements as drawn are not necessarily intended to convey any information regarding the actual shape of particular elements, and have been selected solely for ease of recognition in the drawings.

Figure 1:
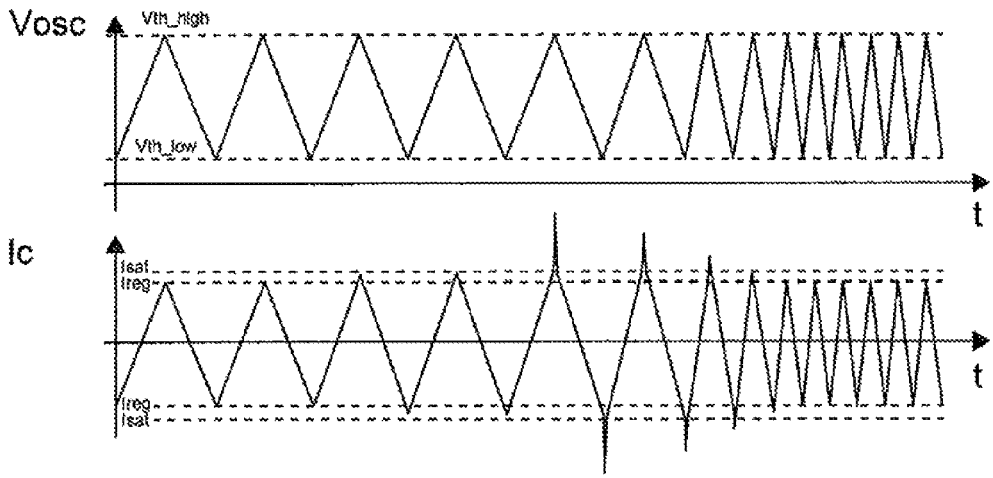
FIG. 1 shows the time diagrams of the output voltage of the oscillator and of the current passing through a choke coil according to prior art.

FIG. 1 shows the triangular output voltage of a prior art oscillator Vosc between the lower threshold Vth-low and the high threshold Vth-high, the over current Ic which overcomes the thresholds Ireg and the saturation current Isat of the choke. When the choke saturates, the driving circuit acts like a short circuit, this causes high di/dt that produces high current peaks, which can be dangerous for the half bridge transistors, because this high peak current can be above the absolute maximum of the transistors. FIG. 1 shows also the delay in the current control due to the limited bandwidth of the loop of the prior art.

Figure 2:
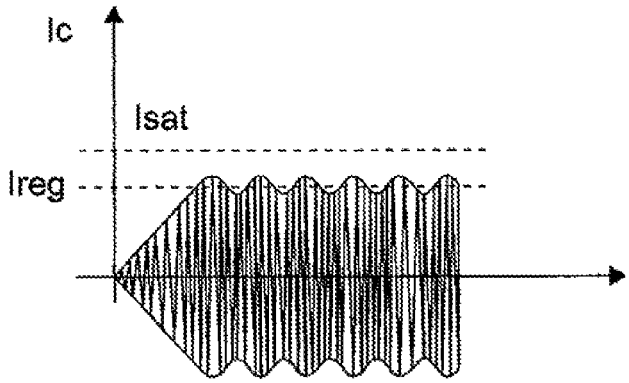
FIG. 2 shows the time diagram of the choke current affected by a ripple.

Also, since the presence of bulk capacitor on the voltage line to which the high side of the half bridge is connected, there is a ripple voltage on the voltage line at twice the mains frequency and the current Ic passing through the choke is also affected by this ripple, as shown in FIG. 2. The limited bandwidth of the prior art loop does not eliminate such ripple but attenuates it; moreover, in case that the saturation current Isat is close to the regulation current, the choke could saturate causing high di/dt.

With reference to FIG. 3 a control device for a discharge lamp according to an embodiment is shown. FIG. 3 show a half-bridge circuit 10, comprising a high side switch T1 and a low side switch T2 (for example, transistors) and is arranged between an high voltage line Vh, to which a bulk capacitor Cbulk is coupled, and ground GND; the half-bridge circuit 10 drives a ballast LOAD comprising a lamp LP by means of a voltage Vin. The ballast LOAD comprises an inductance Lchoke, configured to limit a current passing through the lamp LP, arranged between the common terminal HB of the transistor T1 and T2 and the lamp LP, a filter capacitor C arranged in parallel to the lamp LP and a capacitor Clp arranged between the lamp LP and ground GND. A control circuit 1 drives the half bridge so that a voltage Vin is across the lamp LP and the inductance Lchoke and a voltage Vout is across the capacitor C. The lamp LP may be considered an "open circuit" before the ignition and as a resistor when the lamp is turned on.

The control circuit 1 comprises a switching frequency control including a controller 11 and a driving signal circuit 13, adapted to control the switching frequency of the half bridge, and a comparator 12, for example, a sense comparator, configured to compare a signal HBCS representative of the current Is passing through the low side switch T2 with a reference signal or signal threshold CSth each switching cycle and to control the turning off of the switch T2 and successively, for example, after a delay time Td, the turning on of the high side switch T1 when said further signal is equal to or overcomes said signal threshold cycle by cycle. The current Is is the current Ichoke passing through the inductance Lchoke and through the lamp LP when the ballast LOAD is not supplied by the voltage Vh; the signal threshold may be set so that the trigger of the comparator 12 occurs at the presence of over current or saturation current. In an embodiment, the control circuit 1 is integrated in a chip of semiconductor material.

In an embodiment, the switching frequency control includes a controller 11 configured to generate a triangular signal Vtri, comprising a rise ramp SR and a fall ramp FR, to control the switching frequency of the half bridge and the comparator 12 is configured to generate a signal V12 to control the starting of the fall ramp FR of the triangular signal when said another signal HBCS overcomes said signal threshold CSth cycle by cycle. The device 11 is configured to emit a square wave signal OUT representative of said triangular signal Vtri. The control circuit 1 comprises a driving signal circuit 13 configured to drive the transistors T1 and T2 with the respective signal HSD and LSD in response to the signal OUT. The driving signal circuit 13 may comprise, for example, transistors, logic such as buffers, inverters, etc. to generate signals for driving the transistors T1 and T2 in response to the signal OUT.

In an embodiment said device 11 comprises an oscillator adapted to generate the symmetrical triangular waveform Vtri and the device 12 is a sense comparator having at the inverting terminal the reference signal CSth and at the non-inverting signal the signal HBCS which is the voltage at the terminals of a sense resistance Rs through which the sense current Is passes. On the positive slope SR of the oscillator triangular waveform Vtri the low side transistor T2 is turned on, while on the negative slope FR the high side transistor T1 is turned on.

The peak of the choke current Ichoke flowing through the inductance Lchoke is monitored through the resistance Rs and the voltage HBCS is compared with the internal reference signal or threshold CSth. The regulation current Ireg is given by:

$$Ireg = \frac{CS_{th}}{Rs}$$

with the regulation current less than the saturation current Isat of the inductance Lchoke.

In this way, the size of the choke needed to avoid saturation may be reduced. In fact with the prior art a choke with maximum current of, for example 2.1 A, because of the choke saturation current spread of 30% due to the fabrication process and 10% of the spread cause by temperature variations, it was generally necessary to employ chokes with a saturation current of $$Isat = \frac{2.1A}{1-(0.3+0.1)} = 3.5A$$

which is a 67% oversizing of the choke.

In an embodiment, chokes with saturation currents near loop regulation current may be used. In an embodiment, when the choke has Isat<Ireg, the current in the choke is clamped to the value set by the loop regulation.

Figure 4:
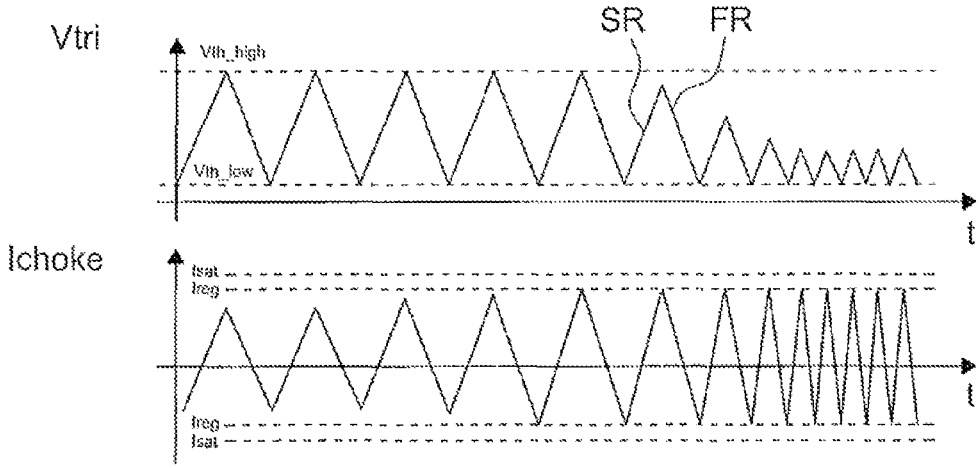
FIG. 4 shows example time diagrams of the output voltage of the oscillator and of the current passing through a choke coil in the embodiment of FIG. 3 with Ireg<Isat.

FIG. 4 shows example time diagrams of the signals Vtri and Ichoke. The signal Vtri is between a low threshold Vth_low and a high threshold Vth_high. When the current Ichoke, that is the current Is flowing through the resistance Rs when the switch T2 is turned on and the switch T1 is turned off, is equal to the value Ireg, that is HBCS=$CS_{th}$, the device 12 acts on the device 11 to control the ramp FR of the signal Vtri to start before the signal Vtri to reach the high threshold Vth_high. FIG. 4 shows the loop response with an over current (e.g. in the event in which the lamp voltage increase during the ignition phase or by broken lamp). It is possible to notice the instantaneous response of the system to the over current event when the choke current reaches the regulation current. There is a substantially immediate turn-off of the low side transistor T2 as soon as the current Ichoke crosses the threshold Ireg, the oscillator positive ramp SR is stopped and the oscillator starts it's discharge thus turning on the high side transistor T1 after a dead time Td.

When the oscillator negative ramp FR is completely discharged the high side transistor T1 is turned off, then after a dead time the low side transistor is again turned on. In absence of over current during the driving of the low side transistor the oscillator triangular waveform Vtri will oscillate between the low threshold Vth_low and the high threshold Vth_high. Therefore, exploiting the oscillator triangular wave it is possible to obtain a duty cycle of 50% (a condition for ballast systems) also in presence of over current.

FIG. 5 shows example time diagrams of the voltage Vtri and the current Ichoke which depict the behavior of the embodiment in FIG. 3 on over current with a choke saturation current Isat lower than the regulation current Ireg; in this case, differently from the case shown in FIG. 4, the peaks of the current Ichoke, due to the choke saturation, are clamped to the value of the regulation current Ireg. With the control circuit 1 the reaching of resonance frequency of the external load may be avoided. In fact, the frequency control is dangerous when the resonance curve has a high "quality factor" Q, indeed little frequency deviations causes big current deviations, whereas the control of the current done on sense resistor Rs clamps the current to the regulation value.

With reference to FIG. 5*a* an embodiment of an implementation of a part of the control device for a discharge lamp according to the embodiment of FIG. 3 is shown. The device 11 of the control device 1 includes an oscillator 112 comprising a sink current generator Q2 and a source current generator Q1 configured to charge and discharge a capacitor Cr connected to ground GND. The voltage across the capacitor Cr is compared with the low threshold Vth_low and a high threshold Vth_high using sense comparators 114, 115. The signal at the output of the comparator 114 represents the set signal S of a flip-flop FF while the signal at the output of the comparator 115 is brought to the input of an OR gate 116 having at the other input the signal V12 at the output of the device 12 which acts as above mentioned for the circuit in FIG. 3. The output signal from the OR gate 116 represents the reset signal R of the flip-flop FF the output Q of which represents the signal OUT used for determining the signals LSD and HSD to drive the transistors T1 and T2 and to control the generators Q1, Q2. The low side transistor T2 is turned on during the rising of the analog ramp, then when this reaches the Vth_high, the ramp changes slope, the low side T2 is turned off and after a dead time Td is turned on the high side transistor T1. The analog ramp then decreases until it reaches the threshold Vth_low, then here the high side T1 is turned off and after a dead time Td is turned on the low side transistor T2. Then at this point the sequence restarts.

With reference to FIG. 6*a* a control device for a discharge lamp according to another embodiment is shown. The difference with respect to the circuit in FIG. 3 is that control device 100 represents a digital solution of the control device 1 in FIG. 3. The control device 100 comprises a up/down counter 110 adapted to generate a digital triangular signal COUNT comprising up and down step ramps. The signal COUNT is at input of a device 120 configured to emit the signal OUT for the device 13 configured to drive transistors T1 and T2 by means of the signal LSD and HSD, as in the analog solution in FIG. 3; the signals COUNT and OUT are shown in FIG. 6*a*. The low side transistor T2 is turned on during the up counting of the up/down counter 110, then when the counting reaches the digital signal FP, that is the frequency preset FP, the counter starts counting down, then the low side T2 is turned off and, after a dead time Td, the high side transistor T1 is turned on. The counter counts down until reaches the digital signal "00 . . . 00", then here the high side T1 is turned off and, after a dead time Td, the low side transistor T2 is turned on; then at this point the sequence restarts.

In the case of a choke saturation the current Ichoke through the inductance Lchoke increases and the comparator 12 switches; this causes the changing of the counting from up to down and the changing of logic level of the OUT signal. When the counting reaches "00 . . . 00", it inverting the counting toward to up and the OUT signal changes its logic level; therefore the signal V12 is adapted to invert the counting direction of the up/down counter 110. The square wave so obtained manages the low side and the high side transistor as in the analog solution.

Example time diagrams of the signals COUNT (compared with the signal Vtri of FIG. 4), LSD, HSD, V12 and HBCS are shown in FIG. 7.

With reference to FIG. 8 a control device for a discharge lamp according to another embodiment is shown. The control device according to the embodiment of FIG. 8 comprises, in the place of the device 12 of the control devices 1 and 100 of FIGS. 3 and 6, a device 500 configured to discriminate between over current and choke saturation current.

The device 500 is able to compare the signal HBCS with at least two different thresholds THL, THM. In an embodiment, the signal HBCS is compared with three different thresholds THL, THM, THH where THH>THM>THL. Indeed the slope of the current Is in the two different conditions (over current and choke saturation) changes, as shown in FIG. 9. The current Is, in the case of over current condition (indicated by OVER CURRENT in FIG. 9), rises slowly from the low threshold THL to the intermediate threshold THM while, in the case of saturation condition of the inductance Lchoke (indicated by CHOKE SATURATION in FIG. 9), rises fastly from the low threshold THL to the intermediate threshold THM and reaches the higher threshold THH. The device 500 is configured to measure the time period $\Delta T_{LM}$ employed by the current Is for reaching from the low threshold THL to the intermediate threshold THM; if the time period $\Delta T_{LM}$ is longer than a threshold time period $\Delta T_{MIN}$, there is the over current situation while if the time period $\Delta T_{LM}$ is lower than a threshold time period $\Delta T_{MIN}$, there is the case of saturation of the inductance Lchoke (CHOKE SATURATION). Therefore the current waveform slope may be recognized. Then if $\Delta T_{LM}>\Delta T_{MIN}$, the control circuit 1, 100 doesn't take initiative, whereas if $\Delta T_{LM}<\Delta T_{MIN}$ then the control circuit 1, 100 consider this as a choke saturation and the low side transistor T2 is turned off substantially immediately and, preferably after a dead time Td, the high side transistor T1 is turned on until to the reaching of the low threshold, then after a dead time Td the transistor T2 is turned on and so on. The third threshold THH is another protection from choke saturation, indeed if this threshold is crossed, then the transistor T2 is turned off substantially immediately, after a dead time Td the transistor T1 is turned on and the loop capacitor discharged to low threshold as in the case above.

The device 500 comprises at least two comparators 501, 502, adapted to compare the voltage HBCS at the terminals of the resistance Rs to respectively the lower threshold THL and the intermediate threshold THM. As illustrated, the device 500 comprises three comparators 501-503 adapted to compare the voltage HBCS at the terminals of the resistance Rs to respectively the lower threshold THL, the intermediate threshold THM and the higher threshold THH. A logic circuit 504 receives the output signals from the comparators 501-503 and is configured to measure the time period $\Delta T_{LM}$ and to compare said measured time period with the prefixed time period $\Delta T_{MIN}$ and to outputs the signal V12 in response to the comparison. In addition, if the logic circuit 504 receives the output signal from the comparator 503, that is the voltage HBCS is equal or higher than the threshold THH, the logic circuit 504 outputs the signal V12.

When the temperature of the inductance Lchoke increases, the choke can saturate for currents Ichoke smaller as reported in FIG. 10 where this situation is indicated by CHOKE HOT while the typical situation wherein the temperature of the inductance Lchoke is not increased is indicated by CHOKE COLD. In the case of CHOKE HOT the current Is rises very fastly from the low threshold THL to the intermediate threshold THM and to the higher threshold THH; in this case, when the current Is crosses the higher threshold THH the device 500 substantially immediately turns off the low side transistor T2 and then turns on the high side transistor T1.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

a switching frequency control module configured to generate one or more signals to control a high-side and a low-side switch of a half bridge of a discharge lamp; and a comparator module coupled to the switching frequency control module and configured to compare a signal representative of a current passing through the discharge lamp with a first threshold and to generate an output of the comparator module based on the comparison, wherein the switching frequency control module is configured to turn off the low-side switch and turn on the high-side switch in response to the output of the comparator module.

2. The device of claim 1 wherein the switching frequency control module is configured to turn off the low-side switch and turn on the high-side switch when the output of the comparator module indicates the signal representative of the current passing through the discharge lamp equals or exceeds the first threshold.

3. The device of claim 1 wherein said switching frequency control module is configured to generate a triangular signal, comprising a rise ramp and a fall ramp, to control a switching frequency of the half bridge and to control starting of the fall ramp of the triangular signal when the output of the comparator module indicates said signal representative of the current passing through the discharge ramp equals or exceeds the first threshold.

4. The device according to claim 3 wherein said switching frequency control module comprises:

a first comparator configured to compare said triangular signal with a low threshold;

a second comparator configured to compare said triangular signal with a high threshold; and a flip-flop having a set input coupled to an output of the first comparator and a reset input coupled to an output of the second comparator and to an output of the comparator module, wherein the switching frequency control module is configured to control the half bridge and the starting of the fall ramp and the rise ramp of the triangular signal based on an output of the flip-flop.

5. The device according to claim 3 wherein said switching frequency control module comprises an up/down counter configured to generate a digital triangular signal comprising up and down step ramps to control the switching frequency of the half bridge, wherein the switching frequency control module is configured to control inversion of a counting direction of the up/down counter based at least in part on whether the output of the comparator module indicates said signal representative of the current passing through the discharge lamp equals or exceeds said first threshold.

6. The device according to claim 1 wherein the signal representative of the current which passes through the discharge lamp is a current passing through a choke inductance coupled to the discharge lamp and through the low-side switch.

7. The device according to claim 1 wherein the switching frequency control module is configured to delay turning on of the high-side switch for a delay time after turning off of the low-side switch.

8. The device of claim 1 wherein the comparator module comprises:

a first comparator configured to compare the signal representative of the current which passes through the discharge lamp with a second threshold; and a second comparator configured to compare the signal representative of the current which passes through the discharge lamp with a third threshold, higher than the second threshold, wherein the comparator module is configured to measure a time period between when the signal representative of the current which passes through the discharge lamp exceeds the second threshold and when the signal representative of the current which passes through the discharge lamp exceeds the third threshold, to compare the measured time period to a threshold time period and to generate the output of the comparator module based on the comparison of the measured time period to the threshold time period.

9. The device of claim 8 wherein the switching frequency control module is configured to turn off the low-side switch and turn on the high-side switch when the output of the comparator module indicates the measured time period is smaller than the threshold time period.

10. The device of claim 1, wherein the switching frequency control module and the comparator module are modules of an integrated circuit.

11. A device, comprising:

a switching frequency control module configured to generate one or more signals to control a high-side and a low-side switch of a half bridge of a discharge lamp; and a comparator module coupled to the switching frequency control module and configured to compare a signal representative of a current through the discharge lamp with at least a first threshold and a second threshold higher than the first threshold, to measure a time period between when the signal representative of the current through the discharge lamp passes the first threshold and when the signal representative of the current through the discharge lamp passes the second threshold, to compare the measured time period to a threshold time period, and to generate a signal to cause the switching frequency control module to turn off the low-side switch and turn on the high-side switch when the measured time period is less than the threshold time period.

12. The device according to claim 11 wherein the comparator module comprises:

a first comparator configured to compare the signal representative of the current through the discharge lamp to the first threshold;

a second comparator configured to compare the signal representative of the current through the discharge lamp to the second threshold; and a third comparator configured to compare the signal representative of the current through the discharge lamp to a third threshold higher than the second threshold, wherein the comparator module is configured to generate the signal to cause the switching frequency control module to turn off the low-side switch and turn on the high-side switch when the signal representative of the current through the discharge lamp exceeds the third threshold.

13. The device according to claim 11 wherein said switching frequency control module is configured to generate a triangular signal, comprising a rise ramp and a fall ramp to control a switching frequency of the half bridge, and to control starting of the fall ramp of the triangular signal based on the signal generated by the comparator module.

14. The device according to claim 13 wherein said switching frequency control module comprises:

a first comparator configured to compare said triangular signal with a low threshold;

a second comparator configured to compare said triangular signal with a high threshold; and a flip-flop having a set input coupled to an output of the first comparator and a reset input coupled to an output of the second comparator and to the signal generated by the comparator module, wherein the switching frequency control module is configured to control the half bridge and starting of the fall ramp and the rise ramp of the triangular signal based on an output of the flip-flop.

15. The device according to claim 11 wherein said switching frequency control module comprises an up/down counter configured to generate a digital triangular signal comprising up and down step ramps to control a switching frequency of the half bridge and to control inversion of a counting direction of the up/down counter based on the signal generated by the comparator module.

16. The device according to claim 11 wherein the signal representative of the current which passes through the discharge lamp is a current passing through a choke inductance connected to the discharge lamp and through the low-side switch.

17. The device according to claim 11 wherein the switching frequency control module is configured to delay turning on of the high-side switch for a delay time after turning off of the low-side switch.

18. The device of claim 11 wherein the switching frequency control module and the comparator module are modules of an integrated circuit.

19. A method, comprising:

controlling a switching frequency of a driving circuit of a discharge lamp, by:

generating drive signals for a high-side switch and a low-side switch of a half-bridge of the discharge lamp;

comparing a signal representative of a current passing through the discharge lamp with at least a first and a second threshold, wherein the second threshold is higher than the first threshold;

measuring a time period between time instants wherein said signal representative of the current passing through the discharge lamp crosses the first and second thresholds;

comparing the measured time period to a threshold time period; and turning off the low-side switch and turning on the high-side switch when said measured time period is smaller than the threshold time period.

20. The method of claim 19, further comprising:

comparing the signal representative of the current through the discharge lamp to a third threshold higher than the second threshold; and turning off the low-side switch and turning on the high-side switch when the signal representative of the current through the discharge lamp exceeds the third threshold.

21. The method of claim 19 wherein the signal representative of the current through the discharge lamp is a current through the low-side switch.

22. A method, comprising:

controlling a switching frequency of a driving circuit of a discharge lamp, by:

generating drive signals for a high-side switch and a low-side switch of a half-bridge of the discharge lamp;

comparing a signal representative of a current passing through the discharge lamp with at least a first threshold; and turning off the low-side switch and turning on the high-side switch when the signal representative of the current through the discharge lamp exceeds the at least a first threshold.

23. The method of claim 22 wherein turning off the low-side switch and turning on the high-side switch comprises resetting a flip-flop.

24. The method of claim 22, further comprising:

delaying turning on of the high-side switch by a delay time after turning off of the low-side switch.

25. A system, comprising:

a discharge lamp having a half bridge with a high-side switch and a low-side switch; and a controller including:

a switching frequency control module configured to generate one or more signals to control the high-side and the low-side switches of the half bridge of the discharge lamp; and a comparator module coupled to the switching frequency control module and configured to compare a signal representative of a current passing through the discharge lamp with a first threshold and to generate an output of the comparator module based on the comparison, wherein the switching frequency control module is configured to turn off the low-side switch and turn on the high-side switch in response to the output of the comparator module.

26. The system of claim 25 wherein said switching frequency control module is configured to generate a triangular signal, comprising a rise ramp and a fall ramp, to control a switching frequency of the half bridge and to control starting of the fall ramp of the triangular signal when the output of the comparator module indicates said signal representative of the current passing through the discharge ramp equals or exceeds the first threshold.

27. The system according to claim 25 wherein said switching frequency control module comprises:

a first comparator configured to compare said triangular signal with a low threshold;

a second comparator configured to compare said triangular signal with a high threshold; and a flip-flop having a set input coupled to an output of the first comparator and a reset input coupled to an output of the second comparator and to an output of the comparator module, wherein the switching frequency control module is configured to control the half bridge and the starting of the fall ramp and the rise ramp of the triangular signal based on an output of the flip-flop.

28. The system according to claim 25 wherein said switching frequency control module comprises an up/down counter configured to generate a digital triangular signal comprising up and down step ramps to control the switching frequency of the half bridge, wherein the switching frequency control module is configured to control inversion of a counting direction of the up/down counter based at least in part on whether the output of the comparator module indicates said signal representative of the current passing through the discharge lamp equals or exceeds said first threshold.

29. A system, comprising:

a discharge lamp having a half bridge with a high-side switch and a low-side switch;

a switching frequency control module configured to generate one or more signals to control the high-side and the low-side switches of the half bridge of the discharge lamp; and a comparator module coupled to the switching frequency control module and configured to compare a signal representative of a current through the discharge lamp with at least a first threshold and a second threshold higher than the first threshold, to measure a time period between when the signal representative of the current through the discharge lamp passes the first threshold and when the signal representative of the current through the discharge lamp passes the second threshold, to compare the measured time period to a threshold time period, and to generate a signal to cause the switching frequency control module to turn off the low-side switch and turn on the high-side switch when the measured time period is less than the threshold time period.

30. The system according to claim 29 wherein the comparator module comprises:

a first comparator configured to compare the signal representative of the current through the discharge lamp to the first threshold;

a second comparator configured to compare the signal representative of the current through the discharge lamp to the second threshold; and a third comparator configured to compare the signal representative of the current through the discharge lamp to a third threshold higher than the second threshold, wherein the comparator module is configured to generate the signal to cause the switching frequency control module to turn off the low-side switch and turn on the high-side switch when the signal representative of the current through the discharge lamp exceeds the third threshold.

* * * * *